US012723756B2

(12) United States Patent
Mindermann

(10) Patent No.: US 12,723,756 B2
(45) Date of Patent: Sep. 1, 2026

(54) CONTROL UNIT FOR DETECTING A FLAME IN OPERATION USING FLAME MONITORS SUITABLE FOR BURNERS AND FLAME MONITORING SYSTEM

(71) Applicant: BFI Automation Mindermann GmbH, Heiligenhaus (DE)

(72) Inventor: Jens Michael Mindermann, Ratingen (DE)

(73) Assignee: BFI Automation Mindermann GmbH, Heiligenhaus (DE)

( * ) Notice: Subject to any disclaimer, the term of this patent is extended or adjusted under 35 U.S.C. 154(b) by 930 days.

(21) Appl. No.: 17/559,714

(22) Filed: Dec. 22, 2021

(65) Prior Publication Data

US 2023/0160571 A1 May 25, 2023

(30) Foreign Application Priority Data

Nov. 25, 2021 (DE) ..... 10 2021 130 911.5

(51) Int. Cl.
*F23N 1/00* (2006.01)
*F23N 5/08* (2006.01)
(Continued)

(52) U.S. Cl.
CPC ..... *F23N 1/005* (2013.01); *F23N 5/082* (2013.01); *F23N 5/206* (2013.01); *F23N 2223/30* (2020.01); *F23N 2229/16* (2020.01)

(58) Field of Classification Search
CPC .. F23N 1/005; F23N 2223/30; F23N 2229/00; F23N 2229/16; F23N 5/082;
(Continued)

(56) References Cited

U.S. PATENT DOCUMENTS 2,306,073 A * 12/1942 Metcalf ..... G05D 23/1928 236/15 E
2,720,623 A * 10/1955 Betz ..... F23N 5/105 361/162
(Continued)

FOREIGN PATENT DOCUMENTS

DE 29 32 129 A1 2/1980
DE 31 42 987 A1 8/1984
(Continued)

OTHER PUBLICATIONS

Office Action from German Patent and Trademark Office for 102021130911.5 dated Jul. 29, 2022, all pages.

*Primary Examiner* — Michael G Hoang
*Assistant Examiner* — Logan P Jones
(74) *Attorney, Agent, or Firm* — Kilpatrick Townsend & Stockton LLP

(57) ABSTRACT

Control unit for detecting a flame in operation using flame monitors suitable for burners operated using a fuel, wherein the flame monitor comprises at least one sensor as operating means for detecting the radiation emission from a flame as a visible reaction between fuel and oxidizing oxygen in a combustion region, and an evaluation circuit associated with the at least one sensor, the evaluation circuit determining whether the radiation received by the sensor corresponds to that of a burning flame and, if the result is negative, generating a fuel supply switch-off signal, wherein at least two flame detectors are connected in such a way that a basic electrical circuit is formed which processes the output signals of the at least two flame monitors via closing contacts in an OR operation or via closing contacts in an AND operation, depending on which of at least two operating states of flame detection is assigned to the output signals of the flame monitors, and a switching logic is
(Continued)

provided for switching between the at least two operating states, which logic links an intelligent subsystem with a logic function plan.

15 Claims, 3 Drawing Sheets

(51) Int. Cl.
*F23N 5/12* (2006.01)
*F23N 5/20* (2006.01)
*F23N 5/24* (2006.01)

(58) Field of Classification Search
CPC . F23N 5/12; F23N 5/123; F23N 5/206; F23N 5/242
See application file for complete search history.

(56) References Cited

U.S. PATENT DOCUMENTS 2,840,146 A * 6/1958 Ray ..... F23N 5/242 250/210
2,874,763 A * 2/1959 Hobbs ..... F23N 5/085 431/51
3,107,594 A * 10/1963 Falkenburg ..... G03B 7/0993 396/233
3,689,773 A * 9/1972 Wheeler ..... G01J 1/1626 431/79
3,737,664 A * 6/1973 Oldenburg ..... F23N 5/082 250/214 R
3,940,753 A * 2/1976 Muller ..... G08B 17/12 250/339.04
3,986,814 A * 10/1976 De Mere ..... F23N 5/022 431/62
4,150,941 A * 4/1979 Obermeier ..... F23N 5/082 126/234
4,395,638 A * 7/1983 Cade ..... F23N 5/082 250/554
8,618,493 B2 12/2013 Mindermann et al.
2005/0256592 A1* 11/2005 Martens ..... C10J 3/728 700/286
2010/0198424 A1* 8/2010 Takehara ..... H01L 31/02021 700/297
2012/0052454 A1* 3/2012 Roy ..... F23N 5/242 431/74
2018/0202653 A1* 7/2018 Karkow ..... F23D 14/145
2020/0182463 A1* 6/2020 Obrecht ..... F23N 5/123

FOREIGN PATENT DOCUMENTS

DE 2 76 409 A3 2/1990
DE 90 11 973 U1 11/1990
DE 197 46 786 C2 10/2000
DE 41 15 255 A1 7/2001
EP 2 439 451 B1 12/2013
FR 1210940 A * 3/1960
FR 1211844 A * 3/1960
FR 1310826 A * 11/1962
GB 625282 A * 6/1949
GB 904758 A * 8/1962
GB 1039594 A * 8/1966
JP 59189216 A * 10/1984

* cited by examiner

CONTROL UNIT FOR DETECTING A FLAME IN OPERATION USING FLAME MONITORS SUITABLE FOR BURNERS AND FLAME MONITORING SYSTEM

CROSS-REFERENCE TO RELATED APPLICATIONS

This application is a non-provisional of and claims the benefit of and priority to German Patent Application No. DE 10 2021 130 911.5, filed Nov. 25, 2021, and entitled "CONTROL UNIT FOR DETECTING A FLAME IN OPERATION USING FLAME MONITORS SUITABLE FOR BURNERS AND FLAME MONITORING SYSTEM," the entire contents of which is incorporated herein by reference for all purposes.

FIELD OF THE INVENTION

The invention relates to a control unit for detecting a flame in operation using flame monitors for furnaces having a burner operated using a fuel, in particular oil or gas. Further, the invention relates to a flame monitoring system having such a control unit.

Such monitors being of the type having a flame sensing circuit with a flame sensor for monitoring the burner flame and switches for controlling the fuel supply. Various flame monitor constructions are known. As they are of considerable importance for the safe operation of furnaces and the like, it is known to use various control techniques.

BACKGROUND OF THE INVENTION

In combustion plants such as burners, it is typical to assign each flame a so-called flame monitor, which is operatively associated with a fuel valve to permit or to stop flow of fuel to the burner. Such flame monitors comprise a radiation detector or flame sensor which generally detects the radiation originating from the flame root. The flame sensor produces a flame signal indicative of the existence of a flame at the burner. In the event of flame loss, the operation of the flame sensor causes switching means to close the fuel valve to stop fuel supply. The flame sensor is usually blacked out by a flame loss.

In view of the above, the radiation being indicative of the existence of a flame at the burner has to be discriminated against the background radiation which originates from the walls enclosing the combustion chamber. Optical flame monitors for such burners typically respond in a spectral range outside the spectrum of visible light. Known flame monitors with high sensitivity respond in the UVA range and are so-called UV tubes or semiconductor sensors based on silicon, GaN, GaP, or GaAsP diodes, which are followed by evaluation circuits having amplifiers. In general, the radiation intensity is evaluated via two thresholds, a prewarning threshold and a safety threshold. The flame monitors process flame sensor signals in such a way that a so-called flame relay is actuated, which, immediately after the flame is extinguished, triggers the safety measures then necessary. The oil burner control circuits usually comprise a number of relays and contacts which switch the components of the burner on and off different times, the components being actuated in particular during the switch-on phase of the burner. With respect to the relays it should be noted that they may be subject to a malfunction.

From DE 90 11 973 U1 it is known that for automatic protection against explosions in combustion plants, as well as for the control of optical combustion processes with the lowest possible pollutant emission, optical flame monitors are preferably used because of their reaction speed. These optical flame monitors use energy released during each combustion process in the form of electromagnetic radiation. This is because each flame has a particular radiation spectrum that depends on both the fuel, e.g., gas, oil, coal, etc., and the type of oxidation. In this context, the spectral radiation distribution ranges from extremely shortwave radiation (UV) through visible light to longwave infrared radiation. Blackbody radiation can be superimposed on this emission spectrum.

The flame monitor comprises a detector which therefore preferably responds in the wavelength range in which the radicals of a combustion process have their emission and absorption behavior. The detector therefore preferably responds in the wavelength range between 280 and 410 nm. The responsivity characteristic curve in relation to the wavelength has steep slopes, wherein these also taper off steeply in the lower range. The damping behavior ensures extensive elimination of the blackbody radiation and the radiation of combustion products other than radicals. For good evaluable amplification, the detector has a minimum responsivity between 0.015 and 0.035 (A/W), preferably 0.025 (A/W), and a response behavior in the range of microseconds, which define a threshold, the exceeding of which indicates the presence and/or the type of a flame. Preferably, these detectors are photoelectric sensors. If a GaP photodiode of the Schottky type having UV filter is used as the detector, the threshold value lies at a radiation intensity of approximately 1000 lux with a minimum short-circuit current of 0.18 μA. Such a detector shows a high responsivity essentially only in the wavelength range 280 to 410 nm.

All flames whether, e.g., gas, oil, coal, etc., are presented in this range with sufficient energy with respect to radiation and are detected in this wavelength range with a minimum responsivity of the responding detector of preferably 0.025 (A/W), eliminating the wavelengths outside the wavelength range of the radicals, amplified, and evaluated for the presence of a flame by comparison to predetermined thresholds for YES/NO responses.

From DE 197 46 786 C2 a flame monitor is known in which a detector with a spectral responsivity in a wavelength range, for example in the near ultraviolet, is used followed by an evaluation circuit, which influences a regulator for the fuel combustion air ratio according to the spectral distribution of the flame radiation. A photoelectric sensor is provided as a detector. An evaluation of the radiation received by the detector, with respect to whether the burner is burning and, in case that it is not burning, to switch off the fuel supply as immediately as possible, is not provided here.

A radiation sensor having a radiation-sensitive diode for ultraviolet light is known from DE 41 15 255 A1. The spectral sensitivity is optimally adapted to the optical emission of blue burning flames of modern oil and gas burners, so that false light cannot appear to be a flame. The very small current, which is generated in a photoelectric manner by the radiation in the diode, is furthermore converted by means of an amplifier circuit into a voltage. The amplifier circuit comprises, for example, an operational amplifier which is fed back by means of a resistor and, if possible a capacitor. In addition to the inputs for connecting the diode, the amplifier circuit has connections for the supply voltage and for the ground and an output to which the output signal is applied. The abovementioned elements as a whole form the radiation sensor, which is arranged inside a hermetically sealed housing.

The known flame monitors provide an output signal when flame is present and no evaluation signal when there is a loss of flame. However, a statement indicative of the existence of a flame at the burner is particularly important for a flame sensing if intensity changes are to be recorded and evaluated.

A flame monitor at oil and gas burners is known from DE 29 32 129 A1, which is designed for self-monitoring in such a way that the flame monitor has self-monitoring, according to which the flame sensor switch is connected in parallel with a bridging switch for the fuel valve and, in the event of flame loss, can be connected with a circuit having two parallel connected alternately operated relays for switching the bridging switch and the element and a timing mechanism. As a result, the operation of the flame sensor and the bridging circuit, as well as the sensing switch, can be checked in a random sequence.

The above-described circuit units comprising flame monitors have the disadvantage that they do enable self-monitoring of the flame monitor with respect to its functionality, but the detection of a locality path of a flame area is not provided for. It has been presumed that it is sufficient to know that a flame having a radiation intensity has been detected at all. For burners with combustion chambers longer than 1 meter, the National Fire Protection Association (NFPA) USA has now stipulated safety regulations that at least one flame monitor is to be provided at each of the ends of a flame area to meet the safety requirements.

SUMMARY

Accordingly, it is an object of the invention to provide a control unit for detecting a flame which, using at least two flame monitors, provides a control signal which is dependent on of a burner flame having radiation intensity and at the same time indicates the loss of a flame, and a flame monitoring system having such a control unit.

This object is achieved by the features of claims 1 and 15.

Thus, a control unit for detecting the existence of a flame at the burner using a fuel with flame monitors and a flame monitoring system is provided, which is based on a sensor technology with several sensors, in particular a two-sensor technology. An intelligent subsystem having a logic functional wiring diagram is integrated to provide switching functions for detecting the presence of a flame and the loss/going out of a flame by means of flame monitors, and in particular for burners whose flame chambers exceed 1 m in length.

Combustion monitoring control units usually have control outputs for valves and ignition systems and an input for flame monitoring. Depending on the mechanism, this input is designed for connection of ionization electrodes, UV tubes, or relay contacts. The connection of at least one additional flame monitor requires the evaluation of several signals. On the one hand, the external light barrier has to trigger itself for external light monitoring of each flame monitor and, on the other hand, each flame monitor has to switch off safely during operation if the flame or a flame section goes out.

According to the invention, it is provided in a first operating state that the at least two outputs are sensed for flame light detection. As a switching function, an OR operation of the at least two flame monitoring outputs is provided. The parallel connection of closing contacts represents an OR element. A relay is energized when the closing contacts controlled by the first "or" the second flame monitoring output are closed.

According to the invention, it is further provided in a second operating state that for flame detection, each of the flame monitors has to detect the flame. In the event of failure/blacked out of a flame monitor, the system must switch off. As a switching function an AND operation of the at least two flame monitoring outputs is provided. The serial connection of closing contacts represents an AND element. A relay is energized when the contacts controlled by the first "and" the second flame monitoring output are closed.

According to the invention, it is further provided that a switching logic is provided for switching between the two operating states. Only one flame monitoring input of an evaluation circuit can be controlled by the switching logic. This can be done, for example, by a changeover relay with two changeover contacts. The changeover relay with two changeover contacts can be used to control a new output relay either in parallel or in series. The changeover relay should preferably be controlled via a fuel valve open—feedback signal. In this case, after the ignition, it is ensured that the at least two flame monitors were able to detect a flame. The fuel valve is a gas valve, for example.

The output of the new output relay can be designed in such a way that various automatic combustion systems can be used. On the one hand, a normal relay contact can be provided, and on the other hand, a resistor with a diode can be connected to an ionization input.

In case that the feedback signal—fuel valve open—is missing or is not connected, an additional forced switching can take place. This can be done via a timer module, which can be designed as a switch-on delay and can be activated when the power supply is switched on. The time delay can be adjustable in order to be able to represent corresponding specifications on the approval side for pre-ventilation and extraneous light control.

Further embodiments of the invention can be learned from the following description and the dependent claims.

BRIEF DESCRIPTION OF THE DRAWINGS

The invention is explained in more detail below with reference to the embodiments shown in the accompanying figures.

DETAILED DESCRIPTION

Figure 1:
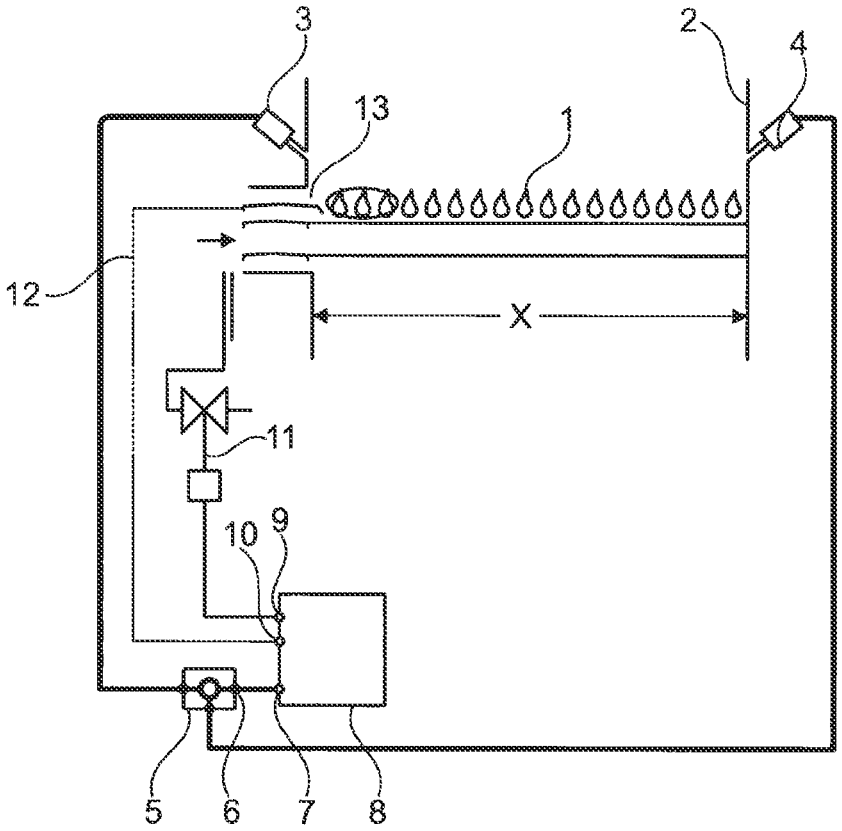
FIG. 1 schematically shows a burner unit with a circuit diagram of a first embodiment of a flame monitoring system for burners, in particular oil or gas burners, FIG. 2 schematically shows a parallel connection of two flame monitoring outputs of the flame monitoring system according to FIG. 1, FIG. 3 schematically shows a series connection of two flame monitoring outputs of the flame monitoring system according to FIG. 1, FIG. 4 schematically shows a circuit diagram of a second embodiment of a flame monitoring system for burners, in particular oil or gas burners.

As shown in FIG. 1, the invention relates to a flame monitoring system for sensing a presence or a loss of flame 1, in particular of an axially extending flame area, at the burner 2 with combustion chamber lengths X of more than 1 m, wherein at least one flame monitor 3, 4 is provided on each of the two ends of the local extension of the flame 1. The flame monitoring system further comprises a control unit 5 as a combustion monitoring device which connects the at least two flame monitors 3, 4 via preferably a control output 6 to an input 7 of a burner control unit 8. The input 7 is thus the input for flame monitoring at the burner control unit, the burner control unit 8 preferably needs to have only one single input 7 for flame monitoring.

In a known manner, the burner control unit 8 further has control outputs 9, 10 for a valve-controlled air supply 11, a gas supply 12 and an ignition system 13.

Figure 2:
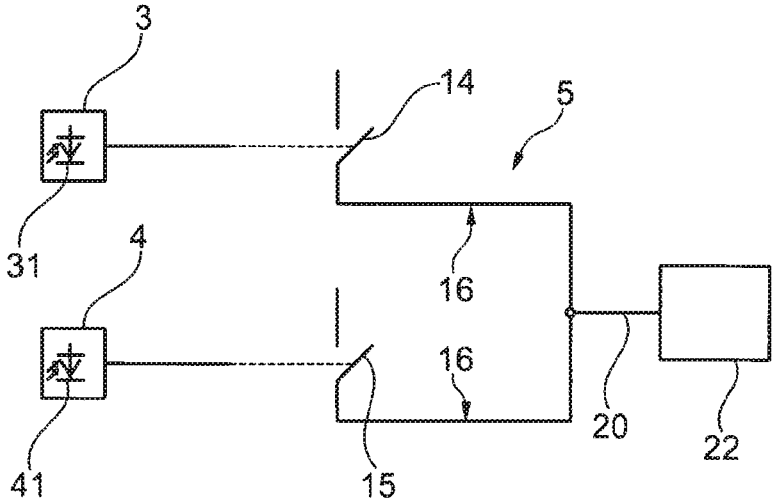
Figure 3:
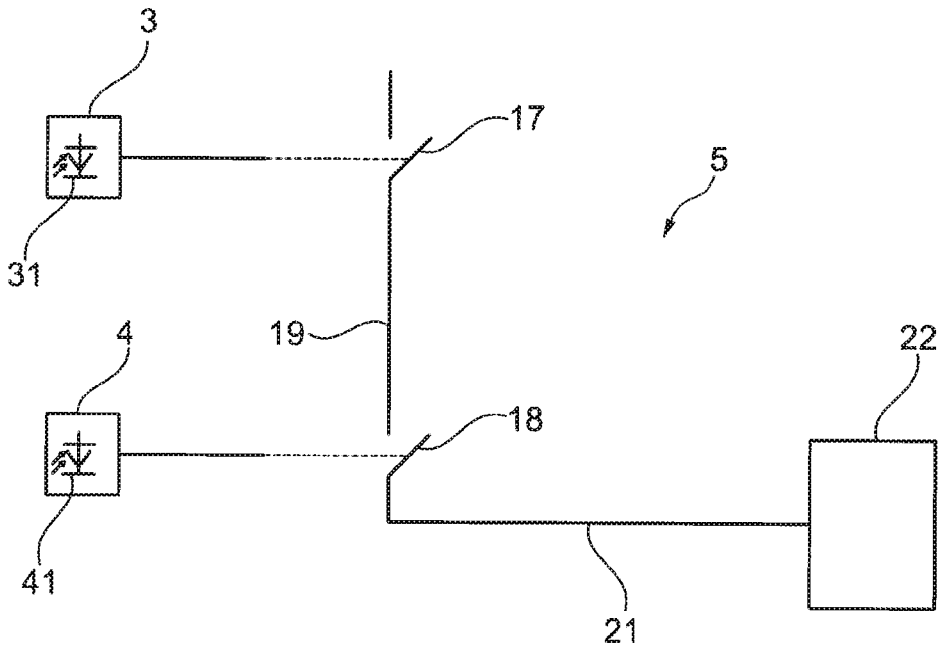

FIG. 2 and FIG. 3 show parts of the control unit 5 according to the invention for detecting the existence of a flame 1 with flame monitors 3, 4 for a burner 2 operated with a fuel. Each flame monitor 3, 4 comprises at least one sensor 31, 41 as operating means for detecting the radiation emission from a flame 1 as a visible reaction between fuel and oxidizing oxygen in a combustion region, and an evaluation circuit (not shown) associated with the at least one sensor 31, 41. The evaluation circuit determines whether the radiation received by the sensor 31, 41 corresponds to that of a burning flame and, if the result is negative, generates a fuel supply switch-off signal. Such flame monitors 3, 4 are described, for example, in EP 2 439 451 B1 and U.S. Pat. No. 8,618,493 B2. Known usable flame monitors of high sensitivity respond in the UVA range and are so-called UV tubes or semiconductor sensors based on silicon, GaN, GaP or GaAsP diodes, which are followed by evaluation circuits with amplifiers.

The at least two flame monitors 3, 4 are connected in such a way that a basic electrical circuit 20, 21 is formed which processes the output signals of the at least two flame monitors 3, 4 via closing contacts 14, 15 in an OR operation 16 or via closing contacts 17, 18 in an AND operation 19. Depending on which of at least two operating states of a flame detection system is assigned to the output signals of the flame monitors 3, 4, processing of the output signals of the flame monitors 3, 4 is performed by a basic circuit control unit 22.

FIG. 2 shows as OR element 16 a parallel connection of the at least two flame monitoring outputs. Both outputs have to be detected to perform flame detection, i.e., the at least two flame monitors 3, 4 must detect a flame 1 to ensure that an axially extending local area of the flame of more than 1 m distance is working completely. The parallel circuit according to FIG. 2 is associated with a first operating state of a timing of detection of the presence of a flame. By means of the parallel circuit it is achieved that the function of a sensor 31, 41 or flame sensor of each flame monitor 3, 4 can in principle be checked at any time sequence, whereby the initial ignition is of particular importance. Notwithstanding this, it is also possible to switch back from the second operating state described below to the first operating state in order to increase the detection options by means of OR operation 16 of flame monitors 3, 4. The number of flame monitors 3, 4 which can be used can vary between two and more, in particular up to ten.

By means of the OR element 16 shown in FIG. 2, it is preferably only possible to switch to a second operating state in case a flame 1 of a burner 2 has ignited correctly in view of time steps, as shown in FIG. 3. The second operating state is then the continuous monitoring for the existence of the flame 1.

FIG. 3 shows as an AND operation 19 a series connection of the at least two flame monitoring outputs. Each of the flame monitors 3, 4 have to be detected. In the event of failure of a flame monitor 3, 4, the system has to switch off as part of the flame detection process that has been carried out. According to a time schedule for the detection of the presence of a flame the series connection according to FIG. 3 is associated to a second operating state. By this series connection it is achieved that the function of a sensor 31, 41 or flame scanner of each flame monitor 3, 4 provides an electrical current interruption in the basic circuit 21 in case of flame loss.

Figure 4:
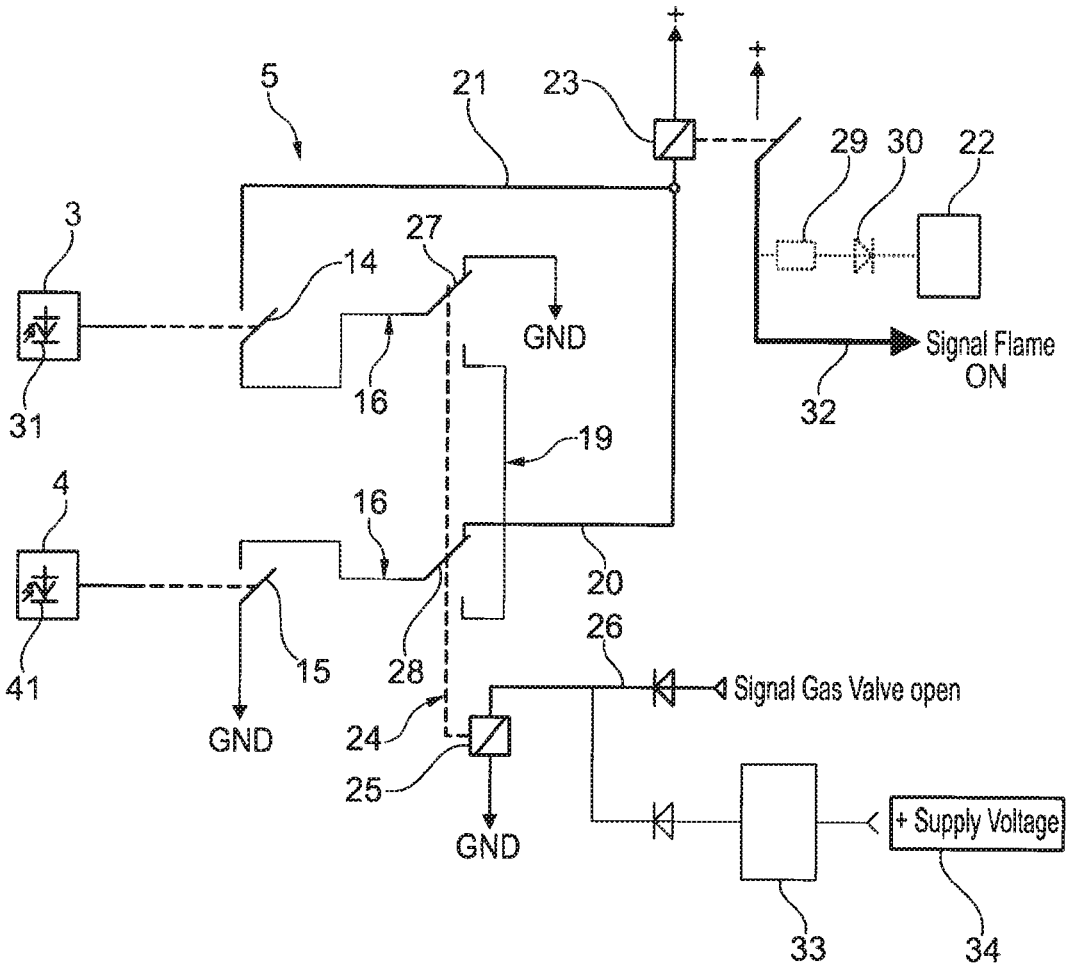

FIG. 4 shows an embodiment in which the basic circuit 20, 21 combines the OR element 16 and AND element 19 to a logic function circuit with a switching logic 24 for switching between the at least two operating states for detecting the existence of a flame 1. The switching logic 24, for example in the form of a changeover relay 25 with two changeover contacts 27, 28, allows an output relay 23 to be controlled either in parallel via the basic circuit 20 or in series via the basic current circuit 21. Consequently, the switching logic 24 links the parallel and serial connection of the flame monitoring outputs as an intelligent subsystem with a logic function plan. Preferably, the switching logic 24 is to be controlled by a feedback signal 26—fuel valve open. In this case, after the ignition, it is ensured that the at least two flame monitors 3, 4 have to detect the flame 1. The fuel valve can be a gas valve, for example.

The contacts 17, 18, shown in FIG. 3, used to define an AND operation 19 are made by changeover contacts 27, 28, since in combination with the OR operation 16 the AND operation is arranged in a subordinate position. In the combination of OR operation 16 and AND operation 19, the outputs of the at least two flame monitors 3, 4 are connected to the make contacts 14, 15 of the OR operation.

The output of the new output relay 23 can be designed so that various automatic burner controls can be used. On the one hand, a normal relay contact can be provided, which is connected via a line 32 to the flame monitoring input 7 on the burner control unit 8. Alternatively or additionally, connection to an ionization input of the basic circuit control unit 22 is also possible via a resistor 29 with diode 30. The basic circuit control unit 22 can also be integrated in the burner control unit 8 (see FIG. 1).

In the event that the feedback signal 26—fuel valve open—fails to appear or is not connected, a forced switchover can also be performed. This can be done via a timer module 33, which can be designed as a switch-on delay and can be activated when the voltage supply 34 is switched on. The time delay can be adjustable in order to be able to represent corresponding specifications on the approval side for pre-ventilation and extraneous light control.

FIG. 1 to FIG. 4 show further preferred embodiments.

The output signals of the at least two flame detectors 3, 4 each switch on/off closing contacts 14, 15; 17, 18, which can also be designed as relays. The output signals are optionally processed in an OR operation for a first operating state of the flame detector or an AND operation for a second operating state of the flame detector. Both combinations are implemented additively in the basic circuit 20, 21, but selectively connected by means of the switching logic 24.

With OR operation 16 for the first operating state, the outputs of the at least two flame monitors 3, 4 are individually detectable by means of a current meter comprised by the control unit 22, for example, if not all flame monitors 2, 3 provide an output signal.

In the AND operation 19 for the second operating state, the outputs of the at least two flame monitors are individually checked and an interruption of the basic circuit can be evaluated by the control unit 22.

The AND operation 19 is preferably a serial connection of the outputs of the flame detectors 3, 4 and the OR operation 16 is preferably a parallel connection of the outputs of the flame monitors 3, 4. The operations can also be replaced by binary elements.

The at least two flame monitors 3, 4 can have binary and/or analog sensors as flame sensors, in particular photosensors.

Burner control 8 may be designed to optimize a mixing ratio of gas and air.

For switching between the at least two operating states, a switching logic 24 is provided. This switching logic 24 combines an intelligent subsystem comprising closing contacts 14, 15, 17, 18, OR element 16, basic electric circuit 20, 21, and AND element 19 with a logic function plan comprising changeover relays 25 and changeover contacts 27, 28.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

The invention claimed is:

1. A system for detecting a flame in operation comprising:

at least two flame monitors, each flame monitor comprising:

a sensor configured to detect radiation emitted by a flame in a combustion region; and an evaluation circuit operatively coupled to the sensor, the evaluation circuit being configured to analyze a signal generated by the sensor to determine whether the detected radiation corresponds to a burning flame; and a control unit operatively coupled to the at least two flame monitors, the control unit comprising:

a logic circuit configured to receive output signals from the evaluation circuits of the at least two flame monitors, wherein at least one flame monitor of the at least two flame monitors is provided on either end of an extension of the flame of a flame field and the at least two flame monitors are connected in such a way as to form the logic circuit that processes the output signals of the at least two flame monitors via closing contacts in an OR operation or via closing contacts in an AND operation, wherein processing of the output signals of the at least two flame monitors is performed depending on which of at least two operating states of flame detection is assigned to the output signals of the flame monitors, wherein in combination with the OR operation the AND operation is arranged in a subordinate position;

switching logic configured to selectively switch between the at least two different operating states of flame detection;

an intelligent subsystem operatively coupled to the switching logic, the intelligent subsystem being configured to implement a logic function plan for controlling one single flame monitoring input of a burner control unit, and to increase the detection options by means of OR operation of said flame monitors a switch back from the AND operation to the OR operation is provided by the switching logic; and an output configured to generate a control signal for a fuel supply system, wherein the control signal indicates whether a flame is detected, and wherein, if the output signals from the at least two flame monitors indicate absence of a flame under the selected operating state, the control signal comprises a fuel supply switch-off signal.

2. A system according to claim 1, wherein the output signals of the at least two flame monitors are each configured to actuate closing contacts comprising relays.

3. A system according to claim 1, wherein the switching logic is configured to process the output signals from the at least two flame monitors in the OR operation for a first operating state or in the AND operation for a second operating state, wherein in the first operating state each flame monitor can individually indicate detection of a flame, and in the second operating state a flame is indicated only if both flame monitors jointly indicate detection of a flame.

4. A system according to claim 1, wherein, in the case of the OR operation for a first operating state, the output signals of the at least two flame monitors are individually detectable and can be evaluated by a current meter comprised by the control unit.

5. A system according to claim 1, wherein, in the case of the AND operation for a second operating state, the output signals of the at least two flame monitors are individually detectable and the control unit is configured to evaluate an interruption of a circuit formed by connecting the at least two flame monitors.

6. A system according to claim 1, wherein the switching logic combines the output signals of the at least two flame monitors in a serial connect for the AND operation and in a parallel connection for the OR operation.

7. A system according to claim 1, wherein the at least two flame monitors are configured to detect sections of the combustion region that are axially spaced apart from one another.

8. A system according to claim 1, wherein the sensor comprises at least one of a binary sensor or an analog sensor.

9. A system according to claim 1, wherein the sensor comprises a photo sensor.

10. A system according to claim 1, wherein the switching logic comprises a changeover relay having at least two changeover contacts for interconnecting the output signals of the flame monitors to provide the OR operation and the AND operation in a common circuit arrangement.

11. A system according to claim 10, wherein a common circuit arrangement selectively switches the OR operation and the AND operation.

12. A system according to claim 10, wherein the switching logic can be actuated via a feedback signal to a fuel valve which can be actuated via a burner control unit.

13. A system according to claim 12, wherein the burner control unit is configured to optimize a mixing ratio of gas and air.

14. A system according to claim 1, further comprising a timer module configured to cause a forced switchover between the OR operation and the AND operation as a function of time.

15. A flame monitoring system for sensing a presence or a loss of a flame for burners with combustion chambers longer than 1 meter, wherein at least one flame monitor of the at least two flame monitors is provided at an end of each flame area, the system according to claim 1 configured to serve as a combustion monitoring unit.

* * * * *